US008119185B2

(12) United States Patent
Hampp et al.

(10) Patent No.: US 8,119,185 B2
(45) Date of Patent: Feb. 21, 2012

(54) PROTECTIVE MATERIAL COMPRISING REVERSIBLE AND IRREVERSIBLE PHOTOCHEMICAL FUNCTIONAL CONSTITUENTS

(75) Inventors: Norbert Hampp, Amöneburg (DE); Martin Neebe, Kirchhain (DE); Arno Schmuck, Leichlingen (DE); Peter Roggendorf, Eckental (DE)

(73) Assignees: Philips-Universitaet Marburg, Marburg (DE); InovisCoat GmbH, Monheim am Rhein (DE)

( * ) Notice: Subject to any disclaimer, the term of this patent is extended or adjusted under 35 U.S.C. 154(b) by 476 days.

(21) Appl. No.: 11/887,480

(22) PCT Filed: Mar. 28, 2006

(86) PCT No.: PCT/EP2006/061105

§ 371 (c)(1),
(2), (4) Date: Sep. 28, 2007

(87) PCT Pub. No.: WO2006/103238

PCT Pub. Date: Oct. 5, 2006

(65) Prior Publication Data

US 2009/0133196 A1 May 28, 2009

(30) Foreign Application Priority Data

Mar. 31, 2005 (EP) ..... 05007043

(51) Int. Cl.
*B41M 3/14* (2006.01)
*B44F 1/12* (2006.01)
*D06L 3/00* (2006.01)

(52) U.S. Cl. ..... 427/7; 8/107; 106/31.13; 106/31.32; 106/31.64; 106/31.94; 252/584; 252/586; 264/212; 427/256; 427/288; 428/195.1; 435/71.1

(58) Field of Classification Search ..... 427/7, 256, 427/288; 106/31.32, 31.64, 31.94, 31.13; 252/586, 584; 430/167, 196, 197, 270.14, 430/495.1, 945, 962; 435/71.1, 71.2, 802, 435/825; 283/70, 92, 94, 901, 904; 264/212; 428/195.1; 8/107
See application file for complete search history.

(56) References Cited

U.S. PATENT DOCUMENTS

| | | | | |
|---|---|---|---|---|
| 4,084,967 | A | 4/1978 | O'Brien et al. | |
| 4,356,256 | A * | 10/1982 | O'Brien et al. | 430/332 |
| 4,927,180 | A | 5/1990 | Trundle et al. | |
| 5,289,547 | A * | 2/1994 | Ligas et al. | 283/72 |
| 5,346,789 | A | 9/1994 | Lewis et al. | |
| 5,374,492 | A * | 12/1994 | Hampp et al. | 430/1 |
| 5,518,858 | A | 5/1996 | Dyukova et al. | |
| 5,807,625 | A | 9/1998 | Amon et al. | |
| 5,854,710 | A | 12/1998 | Rao et al. | |
| 6,287,674 | B1 * | 9/2001 | Verlinden et al. | 428/210 |
| 6,616,964 | B1 * | 9/2003 | Hampp et al. | 427/7 |
| 2004/0054141 | A1 | 3/2004 | Oesterhelt et al. | |
| 2005/0047593 | A1 | 3/2005 | Hampp | |
| 2005/0111270 | A1 * | 5/2005 | Hampp | 365/200 |

FOREIGN PATENT DOCUMENTS

| | | |
|---|---|---|
| DE | 25 30 645 | 1/1976 |
| DE | 199 14 702 | 10/2000 |
| DE | 199 61 841 | 6/2001 |
| GB | 1 154 716 | 6/1969 |
| GB | 1 500 497 | 2/1978 |
| RU | 1 032 912 | 5/1996 |
| WO | WO 03/052701 | 6/2003 |

OTHER PUBLICATIONS

"Bakteriorhodopsin: Vom Molekül zur Anwendung," Nov. 2003. XP-002379196. (ISR).
Research Disclosure Journal No. 37254, Published Apr. 1995, Parts 1-10. (Spec, pp. 14 and 27-31).
Research Disclosure Journal No. 37038, Published Feb. 1995, Parts I-XXIII. (Spec, pp. 14 and 26-31).
Research Disclosure Journal No. 38957, Published Sep. 1996, Parts I-XX. (Spec, pp. 14 and 26-31).
D. Oesterhelt, C. Bräuchle, N. Hampp, "Bacteriorhodopsin: A Biological Material for Information Processing", Quarterly Review of Biophysics, 24 (1991) 425-478. (Spec, p. 7).
A. Miller and D. Oesterhelt, "Kinetic Optimization of Bacteriorhodopsin by Aspartic Acid 96 as an Internal Proton Donor", Biochim: Biophys. Acta 1020 (1990) 57-64. (Spec, p. 8).
H. Otto, T. Marti, M. Holz, T. Mogi, M. Lindau, H.G. Khorana and M. P. Heyn, "Aspartic acid-96 is the internal proton donor in the reprotonation of the Schiff base of bacteriorhodopsin," Proc. Natl. Acad. Sci. USA, vol. 86, Dec. 1989, p. 9228-9232. (Spec, p. 10).
T. E. Thorgeirsson, S.J. Milder, L.J.W. Miercke, M. C. Betlach, R.F. Shand, R.M. Stroud and D.S. Kliger, "Effects of Asp-96→Asn, Asp-85→Asn, and Arg-82→Glen Single-Site Substitutions on the Photocycle of BActeriorhodopsin" Biochemistry, vol. 30 (1991), p. 9133-9142. (Spec, p. 10).
Chignell & Chignell, "A spin label study of purple membranes from . . . ," Biophys. Biochem. Res. Commun., vol. 62, No. 1, 1975, p. 136-143. (Spec, p. 11).
Renthal et al., "Constraints on the Flexibility of Bacteriorhodopsin's Carboxyl-Terminal Tail at the Purple Membrane Surface," Biochemistry, vol. 22 (1983), p. 5-12. (Spec, p. 11).

(Continued)

*Primary Examiner* — Ling Choi
*Assistant Examiner* — Bijan Ahvazi
(74) *Attorney, Agent, or Firm* — Collard & Roe, P.C.

(57) ABSTRACT

The invention relates to a security material comprising a carrier and at least one photochromic Protein and/or a mutein of a photochromic protein. The security material is characterized in that it comprises at least one irreversible photosensitive layer on the carrier, and the at least one photochromic protein and/or mutein is contained at least in the at least one photosensitive layer and/or in an optional additional layer. The inventive security material is also characterized in that it is highly forgery-proof, the photochromic biomolecule cannot be removed therefrom in a usable form, and the photochromic biomolecule does not need to be supplied to a large group of clients.

9 Claims, No Drawings

OTHER PUBLICATIONS

Lohmann et al., J. Inf. Rec. Mats., 1994, vol. 22, pp. 183-193. (Abstract enclosed—publication of Lohmann). (Spec, p. 27).

Hampp et al., "Gentechnologische Modifizierung von Bakteriorhodopsin . . . ," *J. Inf. Rec. Mats*., 1994, vol. 21, pp. 617-618.

International Search Report.

Hampp, Nobert, "Bacteriorhodopsin as a Photochromic Retinal Protein for Optical Memories," Chemical Reviews, Washington, D. C., Bd. 100, Nr. 5, 2000, pp. 1755-1776. XP-000929839. (ISR). (Spec, p. 7).

* cited by examiner

PROTECTIVE MATERIAL COMPRISING REVERSIBLE AND IRREVERSIBLE PHOTOCHEMICAL FUNCTIONAL CONSTITUENTS

CROSS REFERENCE TO RELATED APPLICATIONS

Applicants claim priority under 35 U.S.C. §119 of European Application No. 05007043.2 filed Mar. 31, 2005. Applicants also claim priority under 35 U.S.C. §365 of PCT/EP2006/061105 filed Mar. 28, 2006. The international application under PCT article 21 (2) was not published in English.

TECHNICAL FIELD

The invention relates to materials with a carrier and at least one photochromic protein and/or a mutein of a photochromic protein in a layer thereon and a method for the manufacture thereof including the chemical processing thereof, and the use of such materials.

PRIOR ART

Applications from a safety-engineering point of view for protecting the authenticity of documents or artifacts comprise employing suitable protective features or authentication marks. The advantages of photochromic materials for such applications from a safety-engineering point of view have already been recognized. Embodiments are described, e.g. in U.S. Pat. No. 4,927,180. The photochromic identification feature is made visible in known examples by employing ultraviolet light. It is necessary for the eyes of the authenticity inspector to be suitably protected due to the use of ultraviolet light. Thus, the use of ultraviolet light for identifying protective features may be regarded as disadvantageous. A similar prior art is set forth in U.S. Pat. No. 5,807,625. Here again, ultraviolet light is employed for making the protective feature visible.

A method for protecting the authenticity of artifacts utilizing a photochromic preparation in the form of ink containing bacteriorhodopsin is known from DE 199 14 702 Al. It is also known from example 7 of the above-mentioned DE 199 14 702 A1 to imprint artifacts, e.g. ordinary paper or photo paper with a photochromic preparation and to subsequently laminate it. However, imprinting requires an additional manufacturing step and increases the costs for the manufacture of the protective feature. Even more severely, a security hole may ensue therefrom if imprinting with the photochromic composition takes place, as is often the case, only after illustration with the end customer, since in this case the photochromic composition has to be distributed to a far larger group of clients instead of remaining only with the manufacturer of the protective feature. Moreover, there is the possibility of removing the photochromic paint from the surface of the material once again and re-employing it for forging other documents.

One possibility to avoid this problem is known from DE 199 61 841, in which the photochromic substance is embedded into the substrate itself. Furthermore, WO 03/052701 A2 describes a method, in which a photochromic material may be introduced into the substrate ground mass, and in which the random inhomogeneities of the substrate thus detectable are read out and used as a protective dataset.

However, introducing the photochromic material into the substrate results in a separate basis having to be manufactured for each variant of the photochromic substance instead of using a standard carrier material, making the manufacture more expensive. In addition, it further highly restricts the type of carrier material, which has to be compatible with the photochromic substance during manufacture in order to enable the desired effect.

A specific embodiment of the introduction into the substrate is described in U.S. Pat. No. 5,346,789, wherein a preparation comprising polyvinyl alcohol (PVA) and bacteriorhodopsin (BR) is set to a high pH and a film is made therefrom. Similarly, according to U.S. Pat. No. 5,854,710, a BR containing gel is congealed between two glass plates in order to create a BR containing film.

Finally, a photochromic material is known from U.S. Pat. No. 5,518,858 comprised of a carrier and a photochromic composition located thereon, the photochromic composition comprising a bacteriorhodopsin suspension, at least one organic N containing compound and a binder.

OBJECT OF THE INVENTION

Since attempts at forgery will become more and more elaborate a further increase in forgery proofing of known security materials is desired. Therefore, the invention is based on the object to find a security material being highly forgery-proof. Moreover, the above-mentioned disadvantages of known security materials should be eliminated.

SUMMARY OF THE INVENTION

Surprisingly, it has now been found that the aims can be achieved by using an irreversibly photosensitive material as a security material, in which a photochromic protein or a mutein of a photochromic protein within the layer assembly is contained as a protective feature.

Although the above-mentioned proteins or muteins are very complex biomolecules with many functional groups it was surprisingly found, within the framework of the invention, that the function of the biomolecules is maintained even if the proteins or muteins are built into the security material as early as during manufacture. Differently from expected the exposure process is not importantly influenced by the self light active substances and the photochromic proteins and muteins contained in the layer assembly even survive the effect of the solvents and chemicals necessary for processing, which can have an irreversible effect on the isolated photochromic protein or mutein of a photochromic protein.

Subject-Matter of the Invention

Therefore, the subject-matter of the invention is a security material having a carrier and at least one photochromic protein and/or mutein of a photochromic protein, characterized in that the security material having at least one irreversibly photosensitive layer on the carrier and wherein the at least one photochromic protein and/or mutein is contained in the at least one photosensitive layer and/or an optional additional layer.

The integration of the photochromic protein and/or mutein of a photochromic protein, hereinafter combiningly also referred to as a photochromic biomolecule, can take place directly during manufacture of the security material, and by placing directly into a layer it is not possible to detach the photochromic biomolecule in a usable form, whereby an important point of application is eliminated for forgers. Moreover, the photochromic biomolecule does not need to be made available to a large group of clients. Thus, due to the photochromic biomolecule being difficult to obtain the material according to the invention can hardly be manufactured by a forger nor can it be copied by means of conventional methods since the reproduction generated by means of e.g. photographic or electrophotographic methods does not exhibit a photochromic behavior.

According to the invention irreversibly photosensitive layer is to be understood as any layer with which an irreversible change occurs through illumination, wherein said change may be noticed directly or visually or may initially be present only latently and detected or visually noticed only after a chemical processing.

Examples of irreversibly photosensitive layers according to the invention, in which an irreversible change, which can be detected directly, occurs through illumination, are e.g. layers with dyes which can be destroyed and thus faded through illumination, in particular by means of ultraviolet light, or photopolymerisable layers, which can be applied e.g. in photoresist materials or printing plates.

For the present invention irreversibly photosensitive layers, in which an irreversible change occurs through illumination being present initially only latently and being detectable or visually noticeable only after a chemical processing, are preferred. Such materials have e.g. the advantage of a higher photosensitivity which allows for a lower illumination intensity and thus hardly damages the photochromic protein and/or mutein or not at all. Materials containing such layers are also referred to as photographic materials.

In a preferred embodiment of the present invention the security material is a photographic material having at least one photochromic biomolecule in at least one layer. Particularly preferred are silver halide-based photographic black and white and particularly color materials such as e.g. known for photographic films and copying materials.

It has been found, within the framework of the present invention, that despite the complex layer assembly and the high number of layers associated therewith good particularly good results can be achieved if the security material is a color photographic copying material (e.g. photographic paper) which is suitable for fast processing and the silver halide emulsions of which are comprised in a total of at least 95 mole % of silver chloride. Surprisingly, the photochromic biomolecules and in particular the bacteriorhodopsins are particularly stable in relation to the substances present in such a layer assembly and the fast processing to be applied in this case and forced through high processing temperatures.

Documents with photographic layers allow the fast and cost-effective permanent representation of high-quality illustrations with any other characters, patterns or colors. Thus, e.g. German identity cards and German passports are made of a substrate containing photographic layers.

Moreover, the present invention allows for an elegant combination of the reversible photochromic effect with the irreversible effect created by illumination. The illustrations, signs, patterns or colors which can be created by illumination influence the photochromic process, which is recognizable by means of testing apparatus and/or visually and increases the number of protective variants considerably.

With the carrier according to the present invention it may be one e.g. of paper, plastic-coated paper, cardboard, plastic, metal, glass or a mixture of such materials (so-called "compounds") which may be transparent or non-transparent. Preferably, it is a flexible carrier which can be rolled up and rolled away, in particular one which can be rolled up to a radius of below 10 cm without breaking.

In the security materials according to the present invention the photochromic biomolecule is preferably employed in such a small quantity so that it is no longer visible to the naked eye but can only be detected analytically such that it disturbs the irreversibly created illustrations as little as possible.

It may however also be employed in higher amounts and is thus visually noticeable. The amount required according to the desired effect can be determined by a person skilled in the art by means of common tests. If a clear visual perception is desired about 500 mg or more of the photochromic biomolecule per $m^2$ security material should be employed, whereby, measured in reflection, an optical density of about 0.2 is obtained.

With these densities the photochromic biomolecule results in a considerable color cast in illustrations such as e.g. passport photographs. In this case it is preferable if the security material is a color photographic material and the color cast is compensated by a photographic illumination adapted (filtered) thereto such that a neutral-grey background is created. In this manner the observer does not notice the proper color of the protein even in higher concentrations instead, only a coloring in grey is perceived.

In a preferred embodiment of the present invention the photochromic protein is a retinal protein, in particular a bacteriorhodopsin. Extraction and modification of bacteriorhodopsin is to be described by way of example for the purpose according to the invention, however, the implementations are also valid in an analogous manner for other retinal proteins.

The protein bacteriorhodopsin may be extracted from microorganisms of the species *halobacterium salinarum* in great amounts. Wild type bacteriorhodopsin is known to the person skilled in the art with its basic photochemical and physical properties as a photochromic material, which runs through a cyclic series of intermediates when activated by light. A summary of the mentioned properties of the bacteriorhodopsin is found e.g. in DE 199 14 702 Al, N. N. Vsevolodov, "Biomolecular Electronics: An Introduction via Photosensitive Proteins", Birkhäuser, Boston, 1998; in D. Oesterhelt, C. Bräuchle, N. Hampp, "Bacteriorhodopsin: A Biological Material for Information Processing", Quarterly Review of Biophysics, 24 (1991) 425-478 and N. Hampp, "Bacteriorhodopsin as a Photochromic Retinal Protein for Optical Memories", Chemical Reviews, 100 (2000) 1755-1776.

It is also known to the person skilled in the art that a whole range of variants of the bacteriorhodopsin exists, which have the same initial coloring as the wild type but differ considerably in parts as regards the kinetics of their photocycle. A preferred example is variant BR-D96N. Its properties are described in many publications e.g. in A. Miller, D. Oesterhelt, "Kinetic Optimization of Bacteriorhodopsin by Aspartic Acid 96 as an Internal Proton Donor", Biochim: Biophys. Acta 1020 (1990) 57-64.

For modeling the photochromic properties of the bacteriorhodopsins a highly simplified photocycle is used which contains only two states, referred to as B and M state.

The purple B state may be bleached photochemically, preferably with visible light, in particular at a wavelength of 500 to 600 nm, e.g. 568 nm. With this bleaching the bacteriorhodopsin is transformed into the yellow M state. Returning the bacteriorhodopsin to the original state (B state) may then be achieved photochemically through thermal relaxation and/or irradiation with light of a second wave length range. The photochemical option can be employed e.g. in protective terminals for accelerating the switching operation. Preferably, for this second wave length range wavelengths in the range of 400 to 450 nm, e.g. 412 nm, are used. The total process (switching cycle) according to schematic (I):

(I)

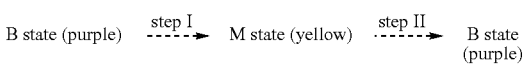

is highly reversible and allows a very high number of more than $10^5$ switching cycles compared to other photochromic substances for both the switching cycles with thermal step II and with photochemical step II. Since each switching cycle corresponds to a testing operation the bacteriorhodopsin correspondingly allows a much higher number of testing operations than other photochromic substances. A further advantage is that for the change of color light of visible wave length can be employed, wherefore no ultraviolet light is required and thus no protection devices or special lamps. Moreover, both switching states have a detectable proper coloring.

The visible bleaching of the bacteriorhodopsin being irradiated is even more easily detectable the higher the lifespan of the M state. Typically, a bleaching of the bacteriorhodopsin material of about 90% is achieved with a light output of less than 100 mW/cm$^2$ at 532 nm.

In a particularly preferred embodiment of the present invention the bacteriorhodopsin (BR) is present in the so-called purple membrane form. In this form it occurs in the microorganisms of the species halobacterium salinarum. Manufacturing and isolating the bacteriorhodopsin in purple membrane form is well-known technically, e.g. from EP 0 406 850 B1. In this form bacteriorhodopsin is known to be thermodynamically particularly stable, compared to the above-mentioned aggressive chemical processing conditions its particular stability found within the framework of the present invention was, however, not to be expected.

In a preferred embodiment of the present invention at least one bacteriorhodopsin function variant and/or at least one bacteriorhodopsin dramatization variant and/or at least one bacteriorhodopsin chromophoric variant and/or at least one bacteriorhodopsin sequence variant is employed. These variants enable e.g. a flexible adaptation to the requirements of the testing operation and allow in particular a correction of the changes in properties, which may occur through the incorporation according to the invention into the security material. Additionally, the variants are difficult to forge and thus provide increased protection. A particularity of the variants is also that apart from the easily detectable protective feature according to schematic (I) also so-called high protective features may be provided, such as described in DE 199 14 702 Al, col. 3 l. 54 to col. 4 l. 30 and that the combination of these protective features allows for an easy to use system which still meets the highest protection requirements.

The use of at least two bacteriorhodopsin variants results in advantageous effects for an analysis since the analysis can be carried out two-dimensionally.

By bacteriorhodopsin function variants in particular are to be understood which differ in their absorption spectrum and/or their photocycle from the bacteriorhodopsin wild type and which can be obtained by using genetically modified methods. One known function variant is e.g. variant D96N, in which aspartic acid is replaced by asparagines in position 96. This bacteriorhodopsin function variant and more are described in: H. Otto, T. Marti, M. Holz, T. Mogi, M. Lindau, H. G. Khorana and M. P. Heyn, Proc. Natl. Acad. Sei. USA. 86 (1989), p. 9228-9232 and T. E. Thorgeirsson, S. J. Milder, L. J. W. Miercke, M. C. Betlach, R. F. Shand, R. M. Stroud and D. S. Kliger, Biochemistry 30 (1991), p. 9133-9142.

By bacteriorhodopsin derivatisation variants bacteriorhodopsin variants in particular are to be understood which differ from the wild type in their covalent coupling of molecules. Such molecules may for example have the task to increase the molecular weight of bacteriorhodopsin in order to be able to identify such a molecule in mass or to be a colored molecule so as to change the absorption spectrum of the bacteriorhodopsin. Preferably it is a fluorescent or phosphorescent molecule in order to be able to observe a luminescence coupled to the bacteriorhodopsin the emission of which represents an additional protective feature. By suitably choosing the position of the emission a suppression of the luminescence may be achieved if the bacteriorhodopsin material is in an unbleached state. This is achieved if the position of the initial bacteriorhodopsin absorption and the emission of the fluorescent and phosphorescent materials strongly overlap. In this case the bacteriorhodopsin material absorbs the emitted photons and luminescence is then not visible to the naked eye. Luminescence is only visible when the bacteriorhodopsin material is bleached photochemically.

Similarly, the bacteriorhodopsin material can also be covalently coupled to a polymer. The coupling reaction can e.g. be carried out according to Chignell & Chignell, Biophys. Biochem. Res. Commun. 62 (1975), p. 136-143 and according to Renthal et al., Biochemistry 22 (1983), p. 5-12.

Link molecules may be coupled to the bacteriorhodopsin which enable to couple further compounds thereto. Molecules, which can be coupled according to the objects according to the invention, serve to increase the molecular weight of bacteriorhodopsin in order to be able to identify such a molecule in mass spectroscopy.

By bacteriorhodopsin chromophoric variant a bacteriorhodopsin variant in particular is to be understood which differs from the wild type in the distance and exchange, respectively, of the chromophoric retinylidene group from another molecule, so-called retinal analogous molecules. Retinal analogous molecules may be bound covalently to the bacteriorhodopsin via lysine 216.

By bacteriorhodopsin sequence variants bacteriorhodopsin variants in particular are to be understood which differ from the wild type through loss or exchange or addition of one or more amino acids, which, however, do not result in a substantial effect on the photocycle. Sequence variants of bacteriorhodopsin are e.g. D36C or variants in which amino acids are attached to the N-terminal or C-terminal. The combination of the modifications of the above-mentioned variants results in new, preferred variants, thus enabling an enormous variety of different bacteriorhodopsin preparations. Due to the enormous number of possible "codes" only a minimal fraction of all possible "codes" of a production are ever usable. Even if the method of coding through specific sequences is known, a forger lacks the information about which codes were ever used.

The bacteriorhodopsin preparation may further contain a conventional non-photochromic pigment and/or a fluorochromic and/or a further photochromic pigment in addition to the bacteriorhodopsin. By mixing with a bacteriorhodopsin the pigment or fluorochromic may be bent within the protective marking. In such an embodiment it may further be convenient to use ultraviolet light in addition to the visible light.

As mentioned, further possibilities for manufacturing bacteriorhodopsin variants by replacing the chromophoric retinylide groups are possible. Thus, a modification of the photophysical properties is achieved, wherein preferably dihydroretinal or 4-ketoretinal may be employed.

Testing the composition of the applied bacteriorhodopsin material can be carried out by totally or partially determining, by means of microanalytical sequencing, the amino acid sequence of the bacteriorhodopsin material or by measuring, by means of immunological methods, the reaction with a specific antibody.

In a preferred embodiment of the present invention the security material contains bacteriorhodopsin variants with purposefully changed amino acid sequences, the sequence change not having an effect on the photophysical properties, and/or with chemically bound molecules. Combinations of two or more of the above bacteriorhodopsin variant types are particularly preferred.

In a further embodiment of the present invention the photochromic biomolecule is a bacteriorhodopsin, in which a) the area necessary for forming the purple membrane form of the protein is unchanged in relation to the bacteriorhodopsin wild type, or b) at least one amino acid exchange is present in relation to the bacteriorhodopsin wild type in loops and/or the C-terminal and/or the N-terminal of the polypeptide chain, comprising deletion, addition, insertions and/or substitutions, said amino acid exchanges not resulting in a change of the photochromic properties of the bacteriorhodopsin determined by the photochromic area.

In a bacteriorhodopsin thus characterized an amino acid is preferably added to the C-terminal.

Further, it is preferred if the bacteriorhodopsin variant contains at least one cysteine and/or one photocycle different from the wild type or has an initial coloring different from the wild type.

For inserting the bacteriorhodopsin e.g. water or organic solvents such as those on an alcohol basis may be used as a solvent.

Besides the preferred purple membrane form of the bacteriorhodopsin the security material according to the invention may additionally contain bacteriorhodopsin in solubilized form.

Bacteriorhodopsin in solubilized form can be obtained by expressing the bacteriorhodopsin gene in a host, e.g. *E. coli*, and reconstituting it with added retinal aldehyde. A further possibility is to obtain the bacteriorhodopsin from purple membrane through removing lipids. For this, e.g. a purple membrane suspension ($OD_{570}<5$) is added to water or buffer with 1% Triton-X 100 and continually treated with ultrasound by means of a micro probe of a sonifier. The surfactant obtained after spinning down contains bacteriorhodopsin in solubilized form.

In a preferred embodiment of the present invention the security material contains ultraviolet absorbing substances. It has been found to be advantageous to accommodate these ultraviolet absorbers within and particularly preferred above the layer, which contains the photochromic biomolecule. Above means a location in the layer assembly being located further from the carrier than the layer containing the photochromic biomolecule. Suitable compounds are found in Research Disclosure 37254, part 8 (1995), p. 292, in Research Disclosure 37038, parts IV, V, VI, VII, X, XI and XIII (1995), p. 84 et seqq. and in Research Disclosure 38957, parts VI, VIII, IX and X (1996), p. 607 and 610 et seqq. Ultraviolet light absorber containing security materials according to the invention are particularly preferred for identifications carried openly and those also containing fluorescence dyes which have to be excited by ultraviolet light.

A further increase in forgery-proofing and increased protection against environmental influences may be carried out through laminating the security material, which can in particular be carried out with transparent plastic films. Lamination may take place unilaterally, an increased protection, however, is achieved by bilateral lamination. Through the laminate the main surfaces of the identification materials can be covered only partially or with an exact match, however, a particularly high protection is achieved through overlaying laminate films, the overlaying edges of which are welded or glued. Within the scope of the present invention it was found that the effect of lamination known per se is particularly distinctive for the materials according to the invention since the assembly of layers, at which the layer containing the photochromic biomolecule has a slightly reduced adherence and it is thus practically impossible to detach the laminated film without destroying the material.

The layer having the photochromic biomolecule may contain the usual known layer additives for photographic materials in order to achieve a good casting quality, adherence and scratch resistance. Besides water e.g. a binder, in particular inert gelatine, a surfactant such as e.g. fluoric tensides or manoxol and agents for setting viscosity, such as e.g. polystyrene sulphonic acid (PSS).

The security material according to the invention usually contains a binder, which, during manufacture, is hardened by addition of a hardener, in particular an immediate hardener, and resists the high temperatures during chemical processing only in this manner. In the presence of photochromic biomolecules. Preferably, the security material according to the present invention contains at least 0.05 g hardener per g binder, in particular at least 0.1 g hardener per g binder.

As with the adjacent layer containing the photochromic biomolecule it has been found to be advantageous if both during manufacture and in the finished material few solvents are present such as e.g. usually used for inserting non-water-soluble substances. If the amount of organic solvent for this is reduced as much as possible by employing the substances e.g. as dispersants or emulgates instead of as solvents or by employing water-soluble compounds where possible, the photochromic activity is hardly affected despite the incorporation into the layer assembly.

The photochromic biomolecule according to the invention may be present in one or more layers of the security material, however, it has been shown, surprisingly, that the photochromic activity increases if it is arranged closer to the carrier and thus covered by a big part of the layer assembly. The layer containing the photochromic biomolecule is particularly preferably arranged directly on the carrier or at a distance from the carrier by a layer only, which contains a binder as a substantial component.

In order to improve the phototropic switching behavior it has been found to be advantageous to admix one of the following substances on its own or in combination to any layer, preferably to a layer adjacent to a BR layer and in particular to a BR layer itself: organic amines and ammonium compounds, peptides and amino acids and the chemical derivatives of the above compounds, preferably amine derivatives of the aromatics and alkanes, particularly substances with primary, secondary, tertiary or quaternary amino groups; particularly preferred are triethanolamine, alkylamine, diaminotolene, betaine, serine, threonine, cysteine, lysine, arginine, tyrosine, asparagine, glutamine, histidine, polyethyleneamine, aminohydroxypyridine and aminomethoxypyridine. Arginine is particularly preferred. The above-mentioned substances particularly result in a reduced dependency on climate of the photochromic behavior and allow an evaluable photochromy even at low relative humidity. The protective materials according to the invention result in a measurable photochromy, preferably in the range from 30 to 100% relative humidity, and this behavior can be controlled by employing the previously mentioned substances. For use in photographic security materials this results in the advantage that the material dries well and then can be welded in and thus gains stability.

Further advantages can be achieved through the security material according to the invention containing substances which react with the developer oxidization product being produced during the chemical processing. Belonging to these are, besides e.g. color, mask-forming and colorless couplers, in particular scavengers, known to the person skilled in the art of photographic materials. Surprisingly, the photochromic activity can be increased through such substances. Preferably, those substances which react with the developer oxidization product are employed in the layer containing the photochromic biomolecule or above it, in particular above it, each layer being preferably employed from 0.03 to 0.5 g/m$^2$, in particular from 0.1 to 0.25 g/m$^2$ of such substances. A high concentration is advantageous for the photochromic effect, however, the amount must not be increased too much in order not to affect the adherence between layers. A person skilled in the art can obtain the optimal amount through the usual tests.

In a preferred embodiment of the present invention a barrier layer is arranged above the layer containing the photochromic biomolecule which is impermeable as far as possible for the developer oxidization product. This can be achieved, e.g. by the barrier layer containing at least one of the above-mentioned substances, which react with the developer oxidization product, but can also be achieved e.g. through the binder and a particularly strong hardening in the barrier layer, whereby the swelling and thus the diffusing in of the developer is avoided.

Severe requirements are made for the stability of identity materials, which also holds true for the stability in relation to bacterial or fungal infections, since such materials are often touched by hand and can thus easily be contaminated. Known bactericides and fungicides, however, cannot be employed unrestrictedly for the security material according to the invention. Thus, it was found surprisingly, that some of the known bactericides and fungicides considerably reduce the photochromic activity. However, the selection of suitable biocides can easily be carried out with a test, wherein the substance to be tested is added to the security material according to the present invention and the material is exposed to a temperature of 60° C. for 48 hours without the relative humidity being controlled. Thereafter, photochromy and cycle number are determined. Materials still having sufficiently detectable photochromic activity after this stress test for the targeted aim are suitable for protective materials according to the invention and the biocides thus tested are suitable for this purpose of employment.

The object of the invention is also a method for manufacturing a security material having a carrier and at least one photochromic protein and/or mutein of a photochromic protein, characterized in that the security material having at least one irreversibly photosensitive layer on the carrier, wherein the at least one photochromic protein and/or mutein are contained in the at least one photosensitive layer and/or in an optional additional layer, and wherein the layer and layers, respectively, are applied onto the carrier as preparations capable of flowing, in particular aqueous preparations.

Application can be carried out according to any known methods, also e.g. through laying on and scraping, respectively, preferably, however, it is carried out by continuous casting methods, in particular cascade and curtain casting, as is known for photographic materials. Particularly preferably, several layers, in particular all layers, are applied onto the carrier at the same time. With the continuous casting method very even layers are possible and it has been shown that layer adherence problems created by introducing photochromic biomolecules into the layer assembly can be reduced considerably compared to non-continuous methods. Also, it was surprisingly found that photochromic activity is improved with this continuous casting method, which could be due to the clean separation of the layers, whereby the layer having the photochromic biomolecule contains no compounds from other layers which could reduce activity. The casting parameters such as viscosity and surface tension can be adapted to the desired casting method and the casting speed according to common methods. For casting speeds around 50 m/min and use of a cascade caster e.g. viscosities of the casting solution have been shown to be suitable between 80 and 120 cPa when using a curtain caster and casting speeds of more than 300 m/min in contrast to viscosities of 300 cPa and above. The pH of the preparation with the photochromic biomolecule (of the casting solution) is preferably from 4 to 7, in particular from 5 to 5.5.

In a further embodiment of the present invention the security material is manufactured in two steps. In the first step the carrier is provided only with layer containing the photochromic biomolecule. This may e.g. have the advantage that such substrated carriers can be manufactured in bulk directly at the manufacturer's. The manufacture may be carried out in the known manner as described above in relation to the prior art by casting the preparation with the photochromic biomolecule on a stationary carrier. However, it was not possible to transfer this method to continuous casting methods which allow only a rational large-scale manufacture. Despite usual setting attempts of the casting solution it was not achieved to cast a preparation containing a photochromic biomolecule directly continuously and with acceptable casting quality onto a carrier. Not until the introduction of an additional layer, containing at least one binder, between carrier and layer with the photochromic biomolecule was a continuous coating of the carrier made possible. Such an intermediate layer is not necessary if the material is cast continuously at the same time with all layers, thus also with the one at least irreversibly photosensitive layer, together in one machine step. For this simultaneous casting preferably cascade and curtain casting machines are used, which are provided with a casting head which contains as many casting slots as the material contains layers, however, also two or more casting heads may be arranged in succession having together the required number of casting slots. Within the scope of the present invention one machine step is to be understood as rolling away the web which is to be cast with one or more layers and its drying. After drying stretch a further caster may be provided along with a downstream drying stretch which allows the second machine step without interruption, however, the dried material may also be wound up after the first or further machine steps. The stretch thus dried may then be cast with further layers in one or more further machine steps. If a further machine step is intended it has been found to be advantageous that an additional layer is applied as the top layer during the previous step acting as an adhering and mediation layer for the layer and layers, respectively, applied in the further machine step and preferably comprises at least one binder and/or at least one thickening agent, in particular a thickening agent.

A further subject-matter of the invention is thus a material having at least two layers on a carrier, characterized in that at least one layer contains at least one photochromic biomolecule and at least another layer is arranged between this layer and the carrier which improves wetting of the carrier with at least one layer containing a photochromic biomolecule and results in a better adherence of this layer. Thus, an evenly coated material having few or no casting errors such as e.g. stripes can be obtained. The at least one layer between carrier and the layer containing the photochromic biomolecule preferably contains at least one binder, in particular a curable binder such as e.g. inert gelatine and/or at least one thickening agent and/or at least one wetting agent. This material can be hardened if it is not to be further cast continuously, for which a hardener is added to the above-mentioned layer or preferably in a separate hardening layer which is suitable for the binder used. Particularly preferably, immediate hardeners known for photographic materials are employed as hardeners.

Within the scope of the present invention it is, however, preferred not to harden the material obtained as described above but to provide it, as described above, as the topmost layer farthest from the carrier with an additional adherence and mediation layer, respectively. Such a material is outstandingly suitable as a basis for a second and further machine step, respectively, in order to obtain the photochromic security material according to the present invention.

A further subject-matter of the present invention is thus a method for manufacturing a security material having a carrier and at least one photochromic protein and/or a mutein of a photochromic protein, characterized in that the security material on the carrier has at least one irreversibly photosensitive layer, the at least one photochromic protein and/or mutein is contained in the at least one photosensitive layer and/or in an optional additional layer, and wherein the layer and layers, respectively, are continuously applied in one, two or more machine steps.

One subject-matter of the present invention is also a method for chemically processing the security material according to the present invention, characterized in that the processing takes place according to the character of the material. Surprisingly, it was found that the processing may take place according to the methods known for the corresponding materials without the photochromic biomolecule. The processing usually comprises for photographic materials, their development, bleaching, fixing and stabilizing and/or watering, wherein bleaching and fixing may often also take place in a processing step.

Within the scope of the present invention is was however found that the development changes the photochromic behavior and may, in particular, reduce the photochromic activity. This undesired effect may however also be utilized in that a processing operation e.g. with particular processing parameters such as e.g. development temperatures and times, may be drawn up which changes the photochromic behavior in a particular manner. Such tests can be carried out easily by a person skilled in the art. If the working conditions thus defined are kept secret and are made known to a very small person subgroup this further increases the protection since not even an exactly forged material can be processed according to type by a forger and thus differs from the legally manufactured and processed material.

In a preferred embodiment of the present invention the processing conditions thus differ in relation to those common conditions according to type for the material without the photochromic biomolecule such that this results in a measurable change of the photochromic biomolecule. If the material according to the invention is e.g. a photographic paper on silver halide basis containing a photochromic biomolecule it is preferably processed with a method which differs from the known type methods for minilabs and big labs such that it results in a measurable change in photochromic activity.

Preferably, the usual development conditions are changed such that the damaging influence of processing is reduced so that color, structure and function of the photochromic biomolecule is not changed substantially and that a photochromic activity as high as possible is achieved. Thus, despite processing a clear color transition is detectable which can also be perceived visually depending on the requirements for the material with a sufficient amount of photochromic biomolecules.

Therefore, it has been found to be advantageous to add particular N containing compounds alone or in combination to at least one processing bath which were mentioned above as preferred layer additives: organic amine and ammonia compounds, peptides and amino acids and the chemical derivatives of said compounds, preferably amine derivatives of aromatics and alkanes, in particular substances with primary, secondary, tertiary, quaternary amino groups; particularly preferably triethanolamine, alkylamine, diaminotoluene, betaine, serine, threonine, cysteine, lysine, arginine, tyrosine, asparagine, glutamine, histidine, polyethylenamine, aminohydroxypyridine and aminomethoxypyridine. Particularly preferred is arginine. These additives may be bathed in to the material before processing, e.g. by guiding the material through an aqueous solution of such a compound before the first processing step. The additives may however also be added to one or more of the processing baths. Particularly preferably the above-mentioned compounds are incorporated by means of a final bath, wherein it may be a stabilizing bath or a simple watering bath. Through such additives the switching behavior is clearly improved and the speed of the color change can be purposefully influenced. Preferably, also combinations of said compounds can be employed in one or different baths, e.g. arginine and triethanolamine.

As a further preferred measure for improving the photochromic switching behavior it was found that the salts commonly used in the baths, in particular in the developer, in particular buffer substances which often have the potassium atom as counterion, such as e.g. potassium carbonate, should be replaced by those with potassium ions.

Moreover, it has been found to be advantageous to avoid organic solvents in the baths as far as possible and to use in at least one, more or all baths, in relation to the total solvent amount in the respective bath, a proportion of at least 20 wt-%, in particular at least 50 wt-%, particularly preferred at least 80 wt-% and if possible 100 wt-% water. If it is not possible to avoid organic solvents preferably those are employed that are particularly compatible with BR, which can easily be identified through simple processing tests.

Preferably, at least one bactericidal and/or at least one fungicidal component is added to at least one processing bath, in particular to the final stabilizing bath.

The subject-matter of the invention is also the use of the security material according to the invention in processed or non-processed form for individualisable documents with increased protection requirements, e.g. in the area of product protection, movement of goods or e.g. in the area of identity cards, passports, identification, Visa and other documents relevant to protection.

Products provided with the feature according to the invention are protected against forgery in a simple manner. The photochromic feature authenticates the product upon visual and/or machine inspection.

A personalized document, a card system or a different item, which serves as authentication for the right to access or right to use a room or a device, may be easily obtained with the feature according to the invention. Here, the feature may involve authentication after machine verification of the visually perceptible or visually non-perceptible photochromy.

A document or a card system or a product containing a feature according to the invention can be inspected not only visually but also by means of devices which detect a change in color or a change in absorption as a result of the alteration in illumination conditions for the feature. For example, this can occur through illumination of the feature with different light-emitting diodes or other light sources and the detection of the reflected or transmitted light via a photodiode or another detector. E.g., the material changes its color from purple to yellow with illumination with light of a light-emitting diode having a maximum emission in the green or yellow range. This can be recognized particularly easily if not all of the surface is illuminated and in particular, if the photographic material in this area has either a small tinge or an tinge created through illumination and processing which leads to a well-detectable and visually perceptible color change, respectively, in cooperation with the color of the photochromic biomolecule. Without further assistance the purple color returns after a few seconds to minutes depending on the preparation used and the initial condition is re-established. Alternatively, the purple color may can immediately be re-established by illuminating with light of a light-emitting diode with a maximal emission in the blue range. The technical effort for testing is minimal. The user can follow the color change with the naked eye, however, the measuring process is preferably carried out mechanically.

The protective feature according to the invention is preferably provided with a protective marking, which can be created simply and still in very complex form e.g. via the photographic layer assembly. With illumination the protective marking changes its color and after a short time of approx. 30 to 60 s and/or with illumination with light of the blue wave length range the original violet color returns.

The materials according to the invention also provide a high copying protection. If such a security material, such as e.g. an identification is copied using a photo copying machine the photosensitive bacteriorhodopsin material is bleached during the copying operation through illumination with light and this condition is frozen irreversibly in the copy, whereby the copy differs clearly recognizably from the original. In order for this effect to be utilized the amount of photochromic biomolecule should be high enough to enable a visual recognition. The copying protection effect can still be reinforced by exposing in a purple color which is similar to the one of the photochromic biomolecule, a pattern which will only be visible when the photochromic biomolecule crosses over into its M state.

Preferred embodiments of the present invention can be inferred from the subclaims.

Examples for color photographic materials are color negative films, color reversal films, color positive films, color photographic paper, color sensitive materials for the color diffusion transfer method or the silver color bleaching method. An overview can be found in Research Disclosure 37038 (1995) and Research Disclosure 38957 (1996).

The photographic materials are comprised of a carrier, onto which at least one photosensitive silver halide emulsion layer is applied. Thin films and foils in particular are suitable as a carrier. An overview of the carrier materials and the supporting layers applied onto their front and back sides are illustrated in Research Disclosure 37254, part 1 (1995), p. 285 and in Research Disclosure 38957, part XV (1996), p. 627.

Color photographic materials usually each contain at least one red-sensitive, green-sensitive and blue-sensitive silver halide emulsion layer and if required intermediate layers and protection layers.

Depending on the type of photographic material the layers can be arranged in different manners. This is represented for the most important products:

Color photographic films such as color negative films and color reversal films have on the carrier, in the following sequence, 2 or 3 red-sensitive, blue-green-coupling silver halide emulsion layers, 2 or 3 green-sensitive, purple-coupling silver halide emulsion layers and 2 or 3 blue-sensitive, yellow-coupling silver halide emulsion layers. The layers of equal spectral sensitivity differ in their photographic sensitivity, wherein the less sensitive partial layers are generally arranged more closely to the carrier than the more sensitive partial layers.

A yellow-filter layer is usually arranged between the green-sensitive and the blue-sensitive layers, which prevent blue light from reaching the layers lying underneath.

The possibilities of the different layer arrangements and their effects on the photographic properties are described in J. Inf. Rec. Mats., 1994, Vol. 22, pages 183-193 and in Research Disclosure 38957 part XI (1996), p. 624.

Color photographic paper, which is generally substantially less sensitive than a color photographic film, has on the carrier, in the following sequence, usually a blue-sensitive, yellow-coupling silver halide emulsion layer, a green-sensitive, purple-coupling silver halide emulsion layer and a red-sensitive, blue-green-coupling silver halide emulsion layer each; the yellow filter layer may be omitted.

Deviations from number and arrangement of the photosensitive layers may be carried out for achieving particular results. For example, all highly sensitive layers may be combined into a layer packet and all low sensitive layers into another layer packet in a photographic film, in order to increase sensitivity (DE-25 30 645).

Substantial components of the photographic emulsion layers are binders, silver halide particles and color couplers.

Information on suitable binders are found in Research Disclosure 37254, part 2 (1995), p. 286 and in Research Disclosure 38957, part II.A (1996), p. 598.

Information on suitable silver halide emulsions, their manufacture, maturation, stabilization and spectral sensitization including suitable spectral sensitizers are found in Research Disclosure 37254, part 3 (1995), p. 286, in Research Disclosure 37038, part XV (1995), p. 89 and in Research Disclosure 38957, part V.A (1996), p. 603.

Photographic materials and camera sensitivity usually contain silver bromide iodide emulsions, which may, if required, also contain low proportions of silver chloride. Photographic coupling materials contain either silver chloride bromide emulsions with up to 80 mole % AgBr or silver chloride bromide emulsions with more than 95 mole % AgCl.

Information on the color couplers are found in Research Disclosure 37254, part 4 (1995), p. 288, in Research Disclosure 37038, part II (1995), p. 80 and in Research Disclosure 38957, part X.B (1996), p. 616. The maximal absorption of the dyes formed from the couplers and color developer oxidization product is preferably in the following ranges: yellow coupler 430 to 460 nm, purple coupler 540 to 560 nm, blue-green coupler 630 to 700 nm.

In color photographic films compounds, which release compounds during the reaction with the developer oxidization product, which are photographically effective, e.g. DIR couplers separating a developer inhibitor, are often employed for improving sensitivity, graininess, sharpness and color separation.

Information on such compounds, in particular on couplers, are found in Research Disclosure 37254, part 5 (1995), p. 290, in Research Disclosure 37038, part XIV (1995), p. 86 and in Research Disclosure 38957, part X.C (1996), p. 618.

The mostly hydrophobic color couplers but also other hydrophobic components of the layers are usually solved or dispersed in highly boiling organic solvents. These solvents or dispersions are then emulsified in an aqueous binder solution (usually gelatine solution) and after the drying of the layers they are present in the layers as fine droplets (0.05 to 0.8 μm in diameter).

Suitable highly boiling organic solvents, methods for incorporation into the layers of a photographic material and further methods for incorporation of chemical compounds into photographic layers can be found in Research Disclosure 37254, part 6 (1995), p. 292.

The non-photosensitive intermediate layers generally arranged between layers of different spectral sensitivity may contain means for preventing an undesired diffusion of developer oxidization products from one photosensitive layer into another photosensitive layer having different spectral sensitization.

Suitable compounds (colorless coupler, scavenger or EOP catcher) can be found in Research Disclosure 37254, part 7 (1995), p. 292, in Research Disclosure 37038, part III (1995), p. 84 and in Research Disclosure 38957, part X.D (1996), p. 621 et seqq.

The photographic material may still contain fluorescent whiteners, spacers, screening dyes, formalin catchers, photoprotection agents, antioxidants, $D_{Min}$-dyes, softening agents (lattices), biocides and additives for improving the coupler and color dye stability, for reducing the color fog and for reducing yellowing and others. Suitable compounds can be found in Research Disclosure 37254, part 8 (1995), p. 292, in Research Disclosure 37038, parts IV, V, VI, VII, X, XI and XIII (1995), p. 84 et seqq. and in Research Disclosure 38957, parts VI, VIII, IX and X (1996), p. 607 and 610 et seqq.

The layers of color photographic materials are usually hardened, e.g. the binder used, preferably gelatine, is cross-linked by means of suitable chemical methods.

Suitable hardener substances can be found in Research Disclosure 37254, part 9 (1995), p. 294, in Research Disclosure 37038, part XII (1995), page 86 and in Research Disclosure 38957, part II.B (1996), p. 599.

After image-wise illumination the color photographic materials are processed corresponding to their character according to various methods. Details in relation to the methodologies and the chemicals needed therefor are published in Research Disclosure 37254, part 10 (1995), p. 294, in Research Disclosure 37038, parts XVI to XXIII (1995), p. 95 et seq. and in Research Disclosure 38957, parts XVIII, XIX and XX (1996), p. 630 et seq. together with exemplary materials.

EXAMPLES

The bacteriorhodopsin suspension (BR suspension) employed in the examples was provided by Marburg University, Prof. Dr. Hampp. The information on concentrations in mg each refer to the amount of bacteriorhodopsin employed.

Example 1

A suitable color photographic recording material suitable for an immediate processing operation was manufactured by applying the following layers in the indicated sequence with a cascade caster onto a layer carrier from paper coated bilaterally with polyethylene. The quantities all refer to 1 $m^2$. For the application of silver halide the corresponding amounts $AgNO_3$ are indicated.

Layer Assembly 101

| | |
|---|---|
| Layer 1a: | (support layer 1) according to Table 1 |
| | 1.84 g gelatine |
| Layer 1b: | (substrate layer) |
| | gelatine according to Table 1 |
| | BR suspension according to Table 1 |
| Layer 1c: | (support layer 2) according to Table 1 |
| | 0.05 g thickening agent VM-1 |
| Layer 2: | (blue-sensitive layer) |
| | blue-sensitive silver halide emulsion |
| | (99.94 mole % chloride, 0.06 mole % |
| | bromide, average grain diameter 0.85 μm) |
| | from 0.39 g $AgNO_3$. |
| | 0.94 g gelatine |
| | 0.375 g yellow coupler GB-1 |
| | 0.125 g yellow coupler GB-2 |
| | 0.30 g dibutylphthalate (DBP) |
| | 0.10 g stabiliser ST-1 |
| Layer 3: | (intermediate layer) |
| | 1.24 g gelatine |
| | BR suspension according to Table 1 |
| | 0.155 g EOP catcher SC-1 |
| | 0.028 g EOP catcher SC-2 |
| | 0.155 g DBP |
| | 0.028 g tricresylphosphate (TCP) |
| Layer 4: | (green-sensitive layer) |
| | green-sensitive silver halide emulsion (99.9 mole |
| | % chloride, 0.1 mole % bromide, average grain |
| | diameter 0.48 μm) from 0.18 g $AgNO_3$. |
| | 0.75 g gelatine |
| | 0.14 g purple coupler according to Table 1 |
| | 0.15 g stabiliser ST-2 |
| | 0.20 g stabiliser ST-3 |
| | 0.186 g TCP |
| Layer 5: | (ultraviolet protection layer) |
| | 1.13 g gelatine |
| | 0.40 g ultraviolet light absorber UV-1 |
| | 0.70 g ultraviolet light absorber UV-2 |
| | 0.125 g EOP catcher SC-1 |
| | 0.021 g EOF catcher SC-2 |
| | 0.125 g DBP |
| | 0.021 g TCP |
| Layer 6: | (red-sensitive layer) |
| | red-sensitive silver halide emulsion (99.7 mole % |
| | chloride, 0.3 mole % bromide, average grain |
| | diameter 0.48 μm) from 0.30 g $AgNO_3$. |
| | 0.73 g gelatine |
| | 0.35 g blue-green coupler BG-1 |
| | 0.35 g TCP |
| Layer 7: | (ultraviolet light layer) |
| | 0.45 g gelatine |
| | 0.148 g ultraviolet light absorber UV-1 |
| | 0.026 g ultraviolet light absorber UV-2 |
| | 0.05 g EOP catcher SC-1 |
| | 0.05 g DBP |
| Layer 8: | (protection layer) |
| | 0.62 g gelatine |
| | 0.059 g fluorescent whiteners WT-1 |
| | 1.20 ml silicone oil |
| | 2.50 mg spacer from polymethylmethacrylate, |
| | average particle size 0.8 μm |
| Layer 9: | (hardening layer) |
| | 0.113 g thickening agent VM-1 |
| | hardener H-1 according to Table 1 |

In layer assembly 101 the following compounds are used:
GB-1
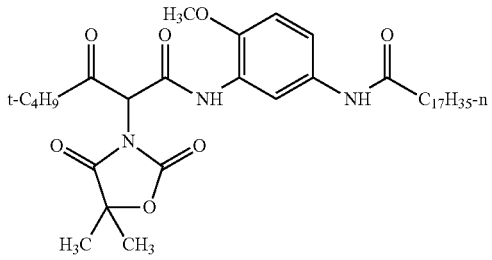
GB-2
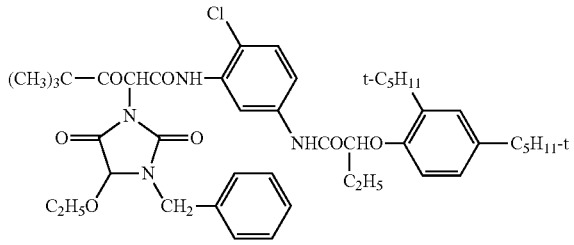
PP-1
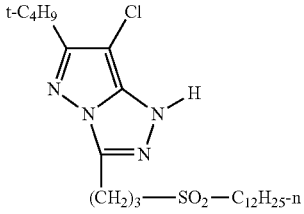
BG-1
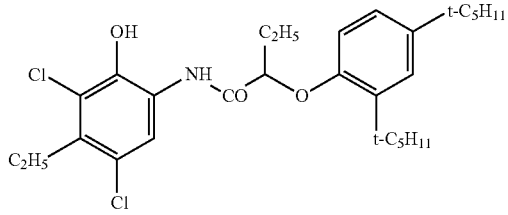
SC-1
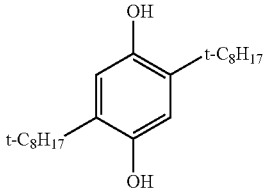
SC-2
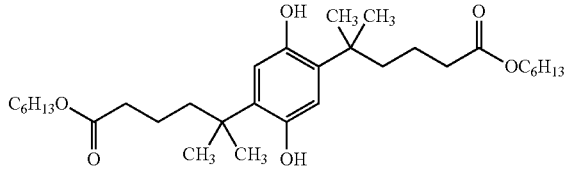
UV-1
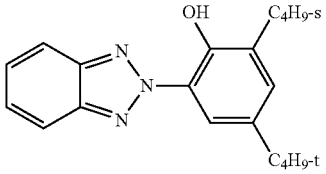
UV-2
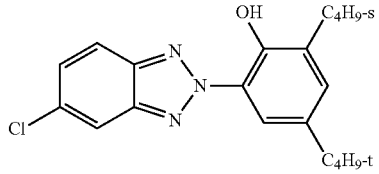
H-1
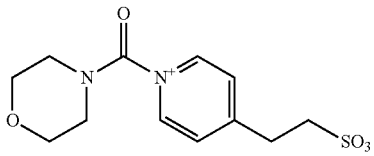
ST-1
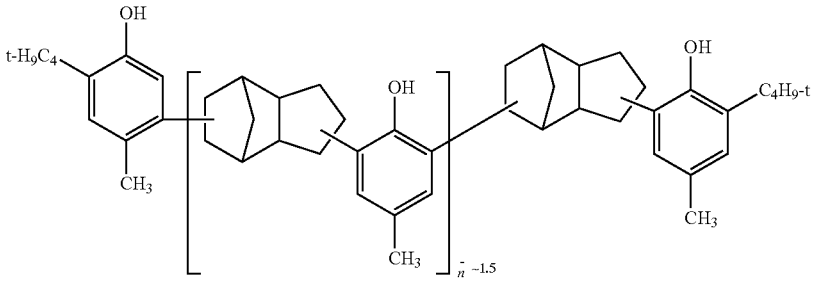
ST-2
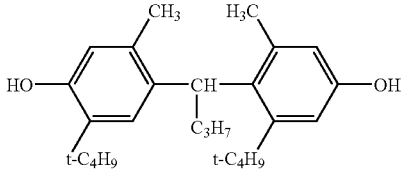
ST-3
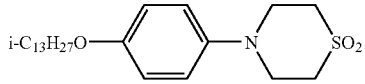

-continued

VM-1

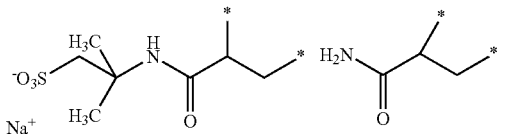

The other layer assemblies differ from 101 as indicated in Table 1. For layer assemblies 101 and 102 layer 1b and layers 1a to 1c, respectively, were initially applied to the carriers, the material was dried and the remaining layers were applied in a separate machine step. The layer assemblies 103 to 105 were, however, cast in a machine step.

TABLE 1

| layer assembly | layer 1a present | amount of BR in layer 1b in mg/m$^2$ | amount of gelatine in layer 1b in g/m$^2$ | layer 1c present | amount of BR in layer 3 in mg/m$^2$ | amount of H-1 in layer 9 in mg/m$^2$ | |
|---|---|---|---|---|---|---|---|
| 101 | no | 150 | 1.92 | no | 0 | 500 | invention |
| 102 | yes | 150 | 1.92 | yes | 0 | 646 | invention |
| 103 | no | 150 | 0.23 | no | 0 | 303 | invention |
| 104 | no | 150 | 0.23 | no | 0 | 646 | invention |
| 105 | no | 0 | 0.23 | no | 150 | 646 | invention |
| 106 | no | 0 | 0.23 | no | 0 | 303 | comparison |

Layer assembly 106 is a photographic copying material containing no photochromic biomolecule and thus exhibits no photochromic behavior. The casting quality, the layer adherence and the scratch resistance are very good both untreated and treated.

Layer assembly 103 differs from 106 only in that the BR suspension is contained in the substrate layer 1b. The casting quality is still good, the layer adherence and scratch resistance, however, only meet very low requirements, which may result in a frilling of the layer assembly. Thus, for short-term processing such a material is not very suitable.

Although the same amount of gelatine is contained in layer assembly 103 as in layer assembly 106, the hardening average amount in layer assembly 104 compared to 103 usually only adapted to the binder amount was increased to more than double the value. Surprisingly, the layer adherence was thus considerably improved and scratch resistance increased.

Layer assembly 105 differs from 104 in that the BR suspension was introduced in layer 3. Layer adherence and scratch resistance were comparable to the layer assembly 104 with the exception that a layer damage during scratching tests now occurred above the yellow layer and not above the basis layer as in layer assembly 104.

Layer assemblies 101 and 102 were made according to an alternative manufacturing method, wherein the carrier material was subbed in a first step with the BR suspension in order for the remaining layer assembly to be cast thereon in a separate machine step. The first step can e.g. also be carried out directly by the manufacturer of the carrier material, whereby the spreading of the biomolecules is further restricted and which allows for the carrier subbed with the photochromic biomolecule to be employed for other purposes than the security material according to the invention.

Surprisingly, the 1$^{st}$ machine step for the layer assembly 101 provided a very unsatisfactory casting quality only with the continuous casting by means of a cascade caster carried out therefor, although a clearly better casting quality was obtained in a pre-test with a common scraper caster. The bad casting quality was noticeable by clear stripes, which stayed visible even after the 2$^{nd}$ machine step, whereby a material thus manufactured is acceptable for very low quality requirements only. Only after embedding the layer contained in the BR suspension by means of support layers 1a and 1b was it possible to achieve good casting quality, which is also comparable in relation to adherence and scratch resistance with layer assembly 104.

Chemical Processing

All samples were processed with a short-time process as follows. The composition of the processing bath, processing time and processing temperature are each indicated.

a) Color Developer, 27 s, 39° C.

| | |
|---|---|
| DEHX solution (diethylhydroxylamine, 85 wt %, aqueous) | 35 ml |
| sodium sulphite | 0.5 g |
| CD3, basis | 31 g |
| diethyleneglycol | 30 ml |
| fluorescent whitener | 7 g |
| polymaleic acid anhydride, 50 wt % aqu. solution | 15 ml |
| potassium carbonate | 100 g |
| set to pH 13.5 with KOH and fill to 5 litres with water. | |

b) Bleaching-Fixing Bath, 27 s, 35° C.

| | |
|---|---|
| ammonium thiosulphate solution, 58 wt. % | 100 ml |
| sodium disulphite | 15 g |
| ammonium-iron EDTA, 48 wt. % | 100 ml |
| fill up with water to 1000 ml, set pH with ammonia or acetic acid to 6.0. | |

c) Stabilizing Bath, 54 s, 33° C.

| | |
|---|---|
| water | 900 ml |
| sodium sulphite | 2 g |
| hydroxyethane diphosphonic acid disodium salt | 4 g |

-continued

| | |
|---|---|
| sodium benzoate | 0.5 g |
| fill up with water to 1000 ml, set pH with acetic acid to 7. | |

d) Drying

The preparation occurred in an AgfaPhoto Minilab of type d.lab 2.

Layer assemblies 101 to 106 were examined with a testing apparatus (terminal) developed at the university in Marburg for its photochromy properties. For this, the material was bleached several times for 1 second each with an LED light of 640 m, and backspaced with an LED light of 405 nm. Thereafter, a mean relative measuring value "Delta-PC", standing for photochromic efficiency and which must be at least 50, in order to enable a secure state differentiation, is obtained. The results are set forth under "photochromy effect "Delta-PC" according to standard processing. The processing tests were repeated, however, with the difference that the stabilizing bath contained 4 wt. % arginine. The results this obtained are represented in Table 2 under "photochromy effect "Delta-PC" with arginine".

Because of bad adherence and casting quality, respectively, the layer assemblies 101 and 103 were not correspondingly evaluated.

TABLE 2

| layer assembly | photochromy effect "Delta-PC" with standard processing | photochromy effect "Delta-PC" with arginine | |
|---|---|---|---|
| 102 | 113 | 165 | invention |
| 104 | 117 | 131 | invention |
| 105 | 106 | 112 | invention |
| 106 | 0 | 0 | comparison |

From the results it clearly arises that the materials according to the invention surprisingly exhibit a distinctive photochromic effect despite integration in the layer assembly and despite chemical processing, wherein this is suitable for employment as a protective feature; that this effect is particularly big if the BR suspension is inserted between carrier and layer assembly; and that the effect is considerably improved through treatment with arginine, wherein this has a particularly clear effect with those materials in which the BR suspension is contained between carrier and layer assembly.

Example 2

Processing Variants

Layer assembly 102 was processed according to variants 201 to 206 according to Table 3.

TABLE 3

| processing variant | summary | "Delta-PC" without arginine | "Delta-PC" with 4 wt. % arginine in stab. bath | "Delta-PC" with 4 wt. % arginine in watering |
|---|---|---|---|---|
| 201 | Na instead of K | 141 | 172 | 205 |
| 202 | no solvent | 144 | 185 | 205 |
| 203 | Na instead of K; no solvent | 158 | 186 | 230 |

TABLE 3-continued

| processing variant | summary | "Delta-PC" without arginine | "Delta-PC" with 4 wt. % arginine in stab. bath | "Delta-PC" with 4 wt. % arginine in watering |
|---|---|---|---|---|
| 204 | triethanol as a solvent | 133 | 169 | 210 |
| 205 | Na instead of K; triethanol as a solvent | 145 | 174 | 219 |
| 206 | standard | 121 | 176 | 201 |

Variant 206 and "Delta-PC" without arginine" are the above-described processing also used for the results according to Table 2. Variants 201 to 205 differ only in the composition of the color developer baths. For variant 201 the potassium carbonate contained therein as replaced by sodium carbonate and the pH was set with NaOH, for variant 202 diethyleneglycol was omitted and for variant 203 the measures of variants 201 and 202 were combined. For variant 204 diethyleneglycol was replaced by the same amount of triethanol and variant 205 represents a combination of the measures according to variant 201 and 204. The results thus obtained are represented in column ""Delta-PC" without arginine". The test run was repeated with the difference, that the stabilizing bath contained 4 wt. % arginine. The results thus obtained are represented in Table 3 in column ""Delta-PC" with 4 wt. % arginine in stab. bath". In a further test run the stab. bath was replaced by water containing 4 wt. % arginine. The results thus obtained are represented in Table 3 in column ""Delta-PC" with 4 wt. % arginine in watering". It is clear from Table 3 that the best results are to be obtained with variant 203, thus without solvent and with sodium ions instead of potassium ions. However, since processing chemicals are often shipped and stored as concentrated solutions the addition of an organic solvent is often indispensable in order to avoid frequently irreversible precipitations. In such a case variants 204 and 205 are a good solution, wherein the organic solvent, which is poorly compatible with the photochromic biomolecule, was replaced by a compatible one, in the case shown by triethanolamine. The treatment with arginine leads to a distinct improvement in the photochromic behavior, which is specifically pronounced if a watering is carried out instead of the stab. bath.

Tests 201 to 206 were repeated as 211 to 216 with the difference that the stabilizing bath and the water bath, respectively, contained 2 wt. % instead of 4 wt. % arginine. The results are summarized in Table 4.

In a further run tests 201 to 206 were repeated as 221 to 226 with the difference that the stabilizing bath and the water bath, respectively, contained 1 wt. % instead of 4 wt. % arginine. The results are summarized in Table 5.

It emerges from comparing Tables 3 to 5 that arginine acts in lower quantities than 4 wt. %, wherein this quantity is preferred for a maximum effect.

TABLE 4

| processing variant | summary | "Delta-PC" without arginine in stab. bath | "Delta-PC" with 2 wt. % arginine in stab. bath | "Delta-PC" with 2 wt. % arginine in watering |
|---|---|---|---|---|
| 211 | Na instead of K | 141 | 160 | 188 |
| 212 | no solvent | 144 | 168 | 202 |
| 213 | Na instead of K; no | 158 | 169 | 207 |

TABLE 4-continued

| processing variant | summary | "Delta-PC" without arginine in stab. bath | "Delta-PC" with 2 wt. % arginine in stab. bath | "Delta-PC" with 2 wt. % arginine in watering |
|---|---|---|---|---|
| 214 | solvent triethanol amine as a solvent | 133 | 164 | 208 |
| 215 | Na instead of K; triethanol a solvent | 145 | 159 | 187 |
| 216 | standard | 121 | 175 | 185 |

TABLE 5

| processing variant | summary | "Delta-PC" without arginine in stab. bath | "Delta-PC" with 1 wt. % arginine in stab. bath | "Delta-PC" with 1 wt. % arginine in watering |
|---|---|---|---|---|
| 211 | Na instead of K | 141 | 155 | 185 |
| 212 | no solvent | 144 | 160 | 200 |
| 213 | Na instead of K; no solvent | 158 | 160 | 193 |
| 214 | triethanol as a solvent | 133 | 159 | 195 |
| 215 | Na instead of triethanol as a solvent | 145 | 158 | 186 |
| 216 | standard | 121 | 154 | 175 |

The invention claimed is;

1. A security material having a carrier, at least a first layer containing at least one photochromic substance selected from the group consisting of a photochromic protein and a mutein of a photochromic protein, and at least a second layer containing a silver halide emulsion, the silver halide emulsion comprising at least 95 mole % silver chloride.

2. The security material according to claim 1, wherein the security material is an identification material.

3. The security material according to claim 1, wherein the at least one photochromic substance is a retinal protein.

4. The security material according to claim 1, wherein the at least one photochromic substance is a bacteriorhodopsin.

5. The security material according to claim 1, further comprising ultraviolet light absorbing substances inside and/or above the first layer.

6. The security material according to claim 1, wherein the first layer is arranged directly on the carrier and is separated from the carrier by one layer only.

7. The security material according to claim 1, further comprising, alone or in combination, substances from the following group of compounds:

organic amines and ammonium compounds, peptides and amino acids and the chemical derivatives of said compounds.

8. The security material according to claim 1, further comprising, alone or in combination, substances from the following group of compounds:

triethanolamine, alkylamine, diaminotoluene, betaine, serine, threonine, cysteine, lysine, arginine, tyrosine, asparagine, glutamine, histidine, polyethyleneamine, aminohydroxypyridine and aminomethoxypyridine.

9. The security material according to claim 1, wherein the security material is an individualized document having a processed or non-processed form.

* * * * *